US009027770B2

(12) United States Patent
Tanaka et al.

(10) Patent No.: US 9,027,770 B2
(45) Date of Patent: May 12, 2015

(54) BOTTLE

(75) Inventors: Toshimasa Tanaka, Tokyo (JP); Hiroaki Imai, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 848 days.

(21) Appl. No.: 11/990,462

(22) PCT Filed: Jul. 24, 2006

(86) PCT No.: PCT/JP2006/314557

§ 371 (c)(1),
(2), (4) Date: Feb. 14, 2008

(87) PCT Pub. No.: WO2007/023630

PCT Pub. Date: Mar. 1, 2007

(65) Prior Publication Data

US 2009/0020497 A1 Jan. 22, 2009

(30) Foreign Application Priority Data

Aug. 23, 2005 (JP) ..... 2005-241140

(51) Int. Cl.

*B65D 90/02* (2006.01)
*A47G 19/00* (2006.01)
*B65D 6/28* (2006.01)
(Continued)

(52) U.S. Cl.

CPC ..... *B65D 1/0223* (2013.01); *B65D 1/0276* (2013.01); *B65D 2501/0036* (2013.01)

(58) Field of Classification Search

CPC .. B65D 1/0223; B65D 1/0276; B65D 79/005; B65D 2501/0036

USPC ..... 215/382, 383, 370; 220/23.86, 608, 220/623, 604, 606

See application file for complete search history.

(56) References Cited

U.S. PATENT DOCUMENTS 3,468,443 A * 9/1969 Marcus ..... 215/375
4,497,855 A * 2/1985 Agrawal et al. ..... 428/36.92
(Continued)

FOREIGN PATENT DOCUMENTS

FR 2 856 380 A 12/2004
JP U 57-174321 11/1982
(Continued)

OTHER PUBLICATIONS

Oct. 5, 2009 Search Report issued in EP 06 78 1479.

*Primary Examiner* — Fenn Mathew
*Assistant Examiner* — Andrew T Kirsch
(74) *Attorney, Agent, or Firm* — Oliff PLC

(57) ABSTRACT

The bottle is provided with a base portion installed on the outer circumference brim of the bottom, a central recess installed inside the base portion and recessed toward the inside of the bottle, an annular wall portion installed between the base portion and the central recess and inclined so as to elevate gradually from the base portion to the central recess, and a plurality of ribs installed side by side at the annular wall portion in the circumferential direction of the bottom and protruding toward the inside of the bottle. The ribs are provided with a rising wall portion rising toward the inside of the bottle and an inclined wall portion inclined from the upper brim of the rising wall portion toward the lower brim of the rising wall portion of an adjacent rib. The rising wall portion is inclined more steeply than the inclined wall portion.

6 Claims, 4 Drawing Sheets

(51) Int. Cl.

| | |
|---|---|
| ***B65D 8/04*** | (2006.01) |
| ***B65D 8/06*** | (2006.01) |
| ***B65D 1/02*** | (2006.01) |

(56) References Cited

U.S. PATENT DOCUMENTS

| | | | | | |
|---|---|---|---|---|---|
| 4,620,639 | A | * | 11/1986 | Yoshino | 215/373 |
| 4,840,289 | A | * | 6/1989 | Fait et al. | 220/270 |
| 4,993,566 | A | * | 2/1991 | Eberle | 215/373 |
| 5,503,283 | A | * | 4/1996 | Semersky | 215/375 |
| 5,763,030 | A | * | 6/1998 | Matsui | 428/35.7 |
| 5,906,286 | A | | 5/1999 | Matsuno et al. | |
| 6,041,961 | A | * | 3/2000 | Farrell | 220/608 |
| 2004/0022976 | A1 | | 2/2004 | Kato et al. | |
| 2007/0000858 | A1 | | 1/2007 | Boukobza | |

FOREIGN PATENT DOCUMENTS

| | | |
|---|---|---|
| JP | U 58-46713 | 3/1983 |
| JP | A 62-028335 | 2/1987 |
| JP | A-04-294735 | 10/1992 |
| JP | A-8-267549 | 10/1996 |
| JP | A-2002-166916 | 6/2002 |
| JP | A 2002-308245 | 10/2002 |

* cited by examiner

BOTTLE

TECHNICAL FIELD

The present invention relates to a bottle into which, for example, a high-temperature liquid is filled.

The present application is to claims the right of priority on the basis of Japanese Patent Application No. 2005-241140 filed on Aug. 23, 2005, with the description cited herein.

BACKGROUND ART OF THE INVENTION

In general, this type of bottle is made from a synthetic resin such as polyethylene terephthalate and produced, for example, by blow molding. In recent years, the energy necessary for re-melting on recycling have been reduced to cope with environmental problems or materials have been used in a smaller quantity to save material costs. As a result, the bottle in itself has been made lighter in weight.

However, a bottle made lighter in weight decreases the rigidity. Therefore, for example, the bottom thereof is softened by heat resulting from a high-temperature liquid filled into the bottle. When the weight of the liquid acts on the thus softened bottom, a base portion installed on the outer circumference brim at the bottom of the bottle is deformed so as to swell toward the outside of the bottle, which may inhibit stability when the bottle is set upright, that is, uprightness. Alternatively, when a bottle, into which a high-temperature liquid is filled, is heated in order to impart sterilization, the internal pressure of the bottle is increased, thereby the base portion at the bottom of the bottle is deformed so as to swell outwardly, which may inhibit the uprightness of the bottle, as described above.

In order to solve the above problem, for example, the technology disclosed in Patent Document 1 given below may be adopted. Specifically, a plurality of hollow ribs protruding outside the bottle to extend in a radial direction are formed so as to be spaced at a predetermined interval in a circumferential direction at an annular recess located between the base portion of a bottle and a central recess installed at the center of the bottom of the bottle. Thereby, the compressive strength of the bottom of the bottle is increased.

PATENT DOCUMENT 1: Japanese Unexamined Patent Application, First Publication No. 2002-308245

DETAILED DESCRIPTION OF THE INVENTION

Problems to be Solved by the Invention

However, in the above-described bottle, since stress tends to concentrate on the outer circumference brim of an annular recess continuing to a joint between adjacent hollow ribs, there is room for improvement in compressive strength of the base portion continuing to the outer circumference brim of the annular recess.

Further, since hollow ribs are formed to make the configuration of the annular recess complicated, there is a case where the inside of a bottle before a content is filled is insufficiently cleaned or a cleaning liquid is not easily and assuredly discharged from the inside of the bottle. As a result, there may be a decrease in the handling property of the bottle.

The present invention has been made in view of the above situation, an object of which is to provide a bottle having a sufficient compressive strength at the bottom thereof without decreasing the handling property even when the bottle is made lighter in weight.

Means for Solving the Problem

The bottle of the present invention is provided with a base portion installed at the outer circumference brim of the bottom of the bottle, a central recess installed inside the base portion and recessed toward the inside of the bottle, an annular wall portion installed between the base portion and the central recess and inclined so as to elevate gradually from the base portion to the central recess and a plurality of ribs installed side by side at the annular wall portion in the circumferential direction of the bottom and protruding toward the inside of the bottle. The rib is provided with a rising wall portion which rises toward the inside of the bottle and an inclined wall portion which is inclined from the upper brim of the rising wall portion to the lower brim of the rising wall portion of an adjacent rib, in which the rising wall portion is inclined more steeply than the inclined wall portion.

According to the present invention, since a plurality of ribs having an inclined wall portion and a rising wall portion, which is steeper than the inclined wall portion, are formed at an annular wall portion on the bottom of the bottle, an increased internal pressure of the bottle will disperse a load acting on a joint between the ridge of each rib, that is, an inclined wall portion of each rib and the rising wall portion from the joint to the inclined wall portion. Further, even when a force is exerted which allows the inclined wall portion to move outside the bottle, with an edge portion opposite to the joint of the inclined wall portion being used as a supporting point, the rising wall portion acts against the force, thereby the inclined wall portion is not deformed so as to move outside the bottle. Therefore, even if there is an increase in internal pressure of the bottle, it is possible to prevent stress from concentrating on a specific site at the outer circumference brim of the annular wall portion. As a result, it is possible to improve the compressive strength of the bottom of the bottle and also prevent the base portion continuing to the outer circumference brim of the annular wall portion from being deformed so as to swell outside.

Further, since the rib has an inclined wall portion, the annular wall portion is not complicated in configuration. Therefore, the inside of the bottle can be sufficiently cleaned before a liquid or the like is filled therein. Still further, since a cleaning liquid can easily flow along the inclined wall portion, the cleaning liquid can be easily discharged from the bottle to prevent a decrease in the handling property of the bottle.

In the bottle of the present invention, when the bottom is viewed from below in the direction of the central axis line of the bottle, the upper brim of the rising wall portion may be inclined to a radial direction of the bottom.

Even when a force is exerted which allows an inclined wall portion to move outside the bottle, with an edge portion opposite to the joint of the inclined portion being used as a supporting point due to the elevated internal pressure of the bottle, the inclined wall portion is deformed so as to cover a rising wall portion. Then, the rising wall portion stops the force, thereby preventing a rib from being expanded in a circumferential direction and deformed so as to be crushed. Therefore, it is possible to further improve the compressive strength of the bottle. It is noted that the rising wall portion is preferably inclined to the base portion in a range from 45 degrees to 90 degrees.

Advantageous Effects of the Invention

The present invention is able to make a bottle lighter in weight without decreasing the handling property and also impart a sufficient compressive strength to the bottom of the bottle.

DESCRIPTION OF THE REFERENCE SYMBOLS

Figure 1:
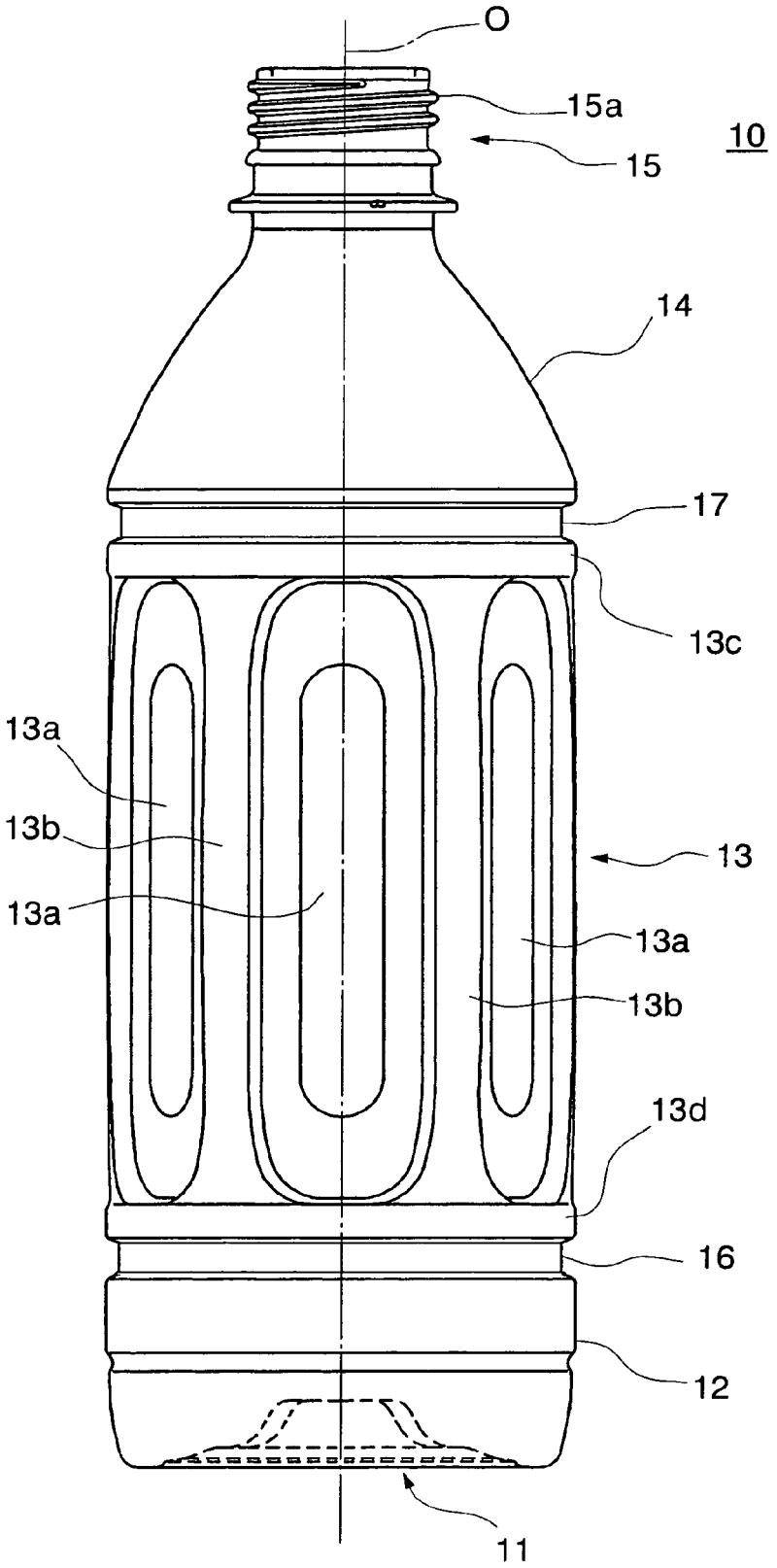
FIG. 1 is a schematic diagram illustrating Embodiment 1 of the bottle of the present invention.

10, 30: BOTTLE
11: BOTTOM
21: BASE PORTION
22: CENTRAL RECESS
23: ANNULAR WALL PORTION
24: INCLINED WALL PORTION
25, 31: RISING WALL PORTION
27: RIB
O: CENTRAL AXIS LINE

BEST MODE FOR CARRYING OUT THE INVENTION

Hereinafter, an explanation will be given for Embodiment 1 of the present invention by referring to the drawings.

As illustrated in FIG. 1, the bottle 10 of the present embodiment is provided with a heel portion 12, a body portion 13, a shoulder portion 14 and a mouth portion 15. The bottle 10 is made with a synthetic resin such as polyethylene terephthalate and produced by, for example, blow molding. The heel portion 12 is provided with a bottom 11. The body portion 13 is installed to be continued to the upper edge portion of the heel portion 12. The shoulder portion 14 is installed to be continued to the upper edge portion of the body portion 13 and gradually reduced in diameter along the upward direction. The mouth portion 15 is installed to be continued to the upper edge portion of the shoulder portion 14 and extended upwardly. The bottom 11, heel portion 12, body portion 13, shoulder portion 14 and mouth portion 15 are formed in an integrated manner along a predetermined axial line. Hereinafter, the axial line is given as a central axis line O. A cross section perpendicular to the central axis line O of the bottle 10 is substantially in a circular shape. A male thread portion 15*a* is made at the mouth portion 15, and a cap (not illustrated) is screwed on at the male thread portion 15*a*.

A plurality of panel portions 13*a* are installed at the body portion 13 so as to be spaced at an equal interval along the circumferential direction of the body portion 13. Each of the panel portions 13*a* is formed so as to be recessed internally in a radial direction of the body portion 13. A column portion 13*b* extending toward the central axis line O is formed between the adjacent panel portions 13*a*. The panel portion 13*a* and the column portion 13*b* are arranged alternately along the circumferential direction of the body portion 13. The panel portion 13*a* is formed along a full length excluding the upper edge portion 13*c* and the lower edge portion 13*d* in the direction of the central axis line O of the body portion 13. The panel portion 13*a* and the column portion 13*b* are formed with six pieces each.

An annular recess groove 16 is formed at a joint between the heel portion 12 and the body portion 13 all along the circumference in the circumferential direction of the body portion 13, and an annular recess groove 17 is formed at a joint between the body portion 13 and the shoulder portion 14 all along the circumference in the circumferential direction of the body portion 13.

Figure 2:
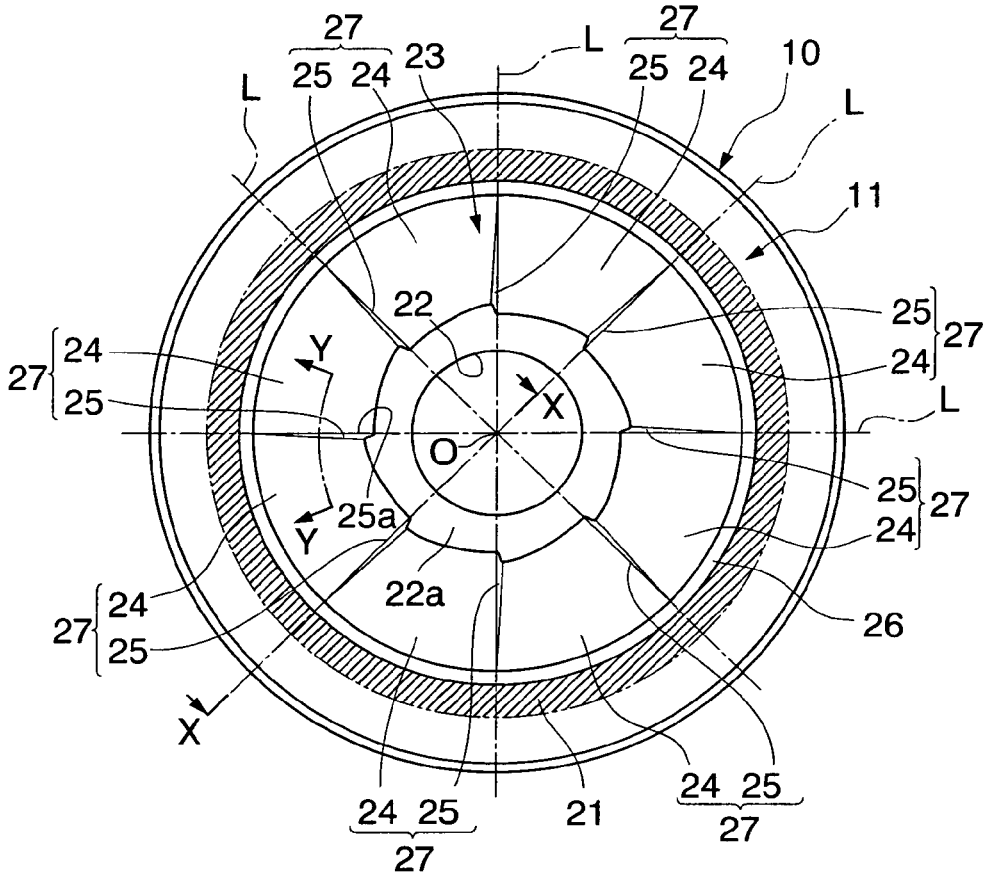
FIG. 2 is a view for illustrating Embodiment 1 of the bottle of the present invention and shows a plan view when the bottom of the bottle given in FIG. 1 is viewed below.
Figure 3:
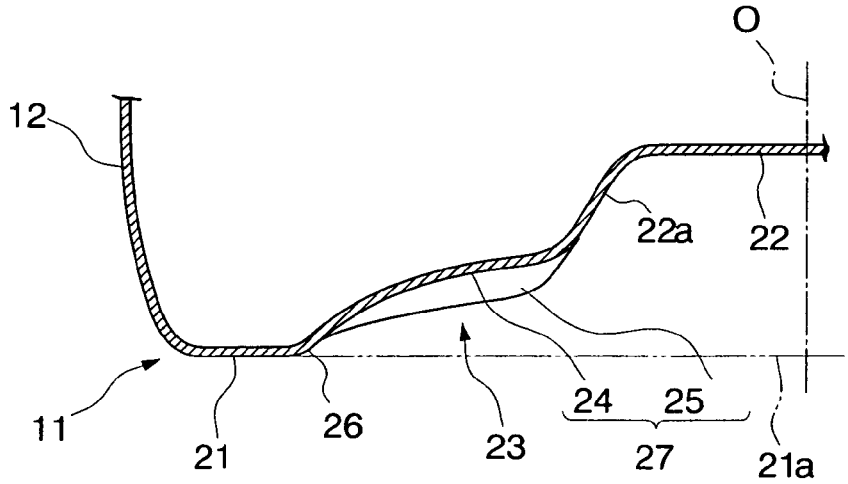
FIG. 3 is a view for illustrating Embodiment 1 of the bottle of the present invention and a cross sectional view of the bottle cut along the line X-X given in FIG. 2.

As illustrated in FIG. 2 and FIG. 3, the bottom 11 is provided with a base portion 21, a central recess 22, an annular wall portion 23, and a plurality of ribs 27. The base portion 21 is installed on the outer circumference brim of the bottom 11, and touches the ground when the bottle 10 is set upright, with the mouth portion 15 kept above the base portion 21. The central recess 22 is installed on the inside of the base portion 21 and recessed toward the inside of the bottle 10. The annular wall portion 23 is installed between the base portion 21 and the central recess 22 and inclined so as to elevate gradually from the base portion 21 to the central recess 22.

A plurality of ribs 27 are installed side by side in the circumferential direction of the bottom 11 and protruding toward the inside of the bottle 10. Each of the ribs 27 is provided with a rising wall portion 25 and an inclined wall portion 24. The rising wall portion 25 rises steeply toward the inside of the bottle 10. The inclined wall portion 24 rises gently toward the inside of the bottle 10. The rising wall portion 25 is steeper than the inclined wall portion 24. It is noted that the number of ribs 27 is preferably from 4 to 16.

When the bottom 11 is viewed in the direction of the central axis line O from the outside of the bottle 10, the inclined wall portion 24 is formed in a circular arc shape at which the length along the circumferential direction of the bottom 11 is made longer as it moves closer to the base portion 21, in other words, a fan shape. The rising wall portion 25 is formed in a triangular shape so as to be tapered as it comes closer to the base portion 21, when the bottom 11 is also viewed in the direction of the central axis line O outside of the bottle 10. The inclined wall portions 24 are all formed in the same shape and the rising wall portions 25 are also all formed in the same shape. The inclined wall portion 24 and the rising wall portion 25 are alternately arranged in the circumferential direction of the bottom 11. Further, the circumferential face 22*a* of the central recess 22 is formed in a ratchet shape.

As illustrated in FIG. 3, when a face at which the heel portion 12 is cut along the central axis line O is viewed, the inclined wall portion 24 is inclined from the base portion 21 to the central recess 22 and also curved so as to be recessed toward the inside of the bottle 10. Further, as illustrated in FIG. 4, when a face at which the rib 27 is cut along the circumferential direction is viewed, the inclined wall portion 24 is formed in a flat-face shape and inclined from the lower brim of the rising wall portion 25 of an adjacent rib 27 toward the upper brim 25*a* of the rising wall portion 25 to give the rib 27 in combination with itself.

Further, the edge portion of the inclined wall portion 24 located inside the bottom 11 in a radial direction and the edge portion of the rising wall portion 25 located inside in the radial direction are made steeper along the central recess 22, smoothly continuing to the circumferential face 22*a* of the central recess 22.

As illustrated in FIG. 2, when the rib 27 is viewed from below in the direction of the central axis line O, the upper brim 25*a* of the rising wall portion 26 is extended in a direction coincident with a radial direction of the bottom 11 of the bottle 10. In other words, the upper brim 26*a* of the rising wall portion 25 is extended in a direction coincident with a direction that a line L is extended which connects a point at which the rising wall portion 25 is in contact with the base portion 21 with the center of the bottle 10 (central axis line O).

Figure 4:
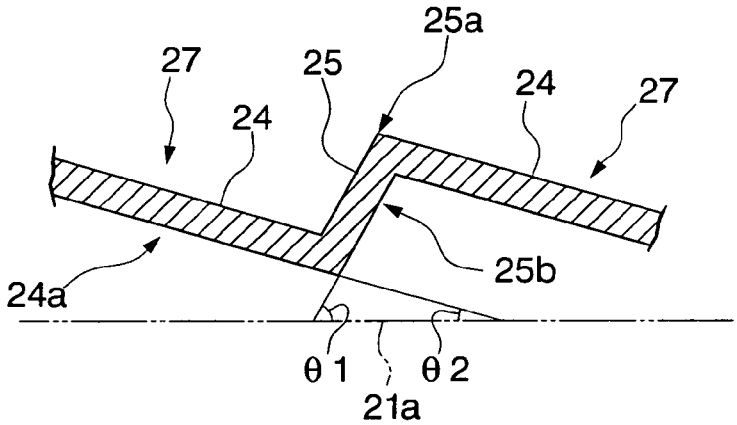
FIG. 4 is a view for illustrating Embodiment 1 of the bottle of the present invention and a cross sectional view of the bottle cut along the line Y-Y given in FIG. 2.

Further, as illustrated in FIG. 4, when the bottom 11 is viewed from the cross section along the circumferential direction, an angle θ1 made by the outer surface 25*b* of the rising wall portion 25 and the outer surface 21*a* of the base portion 21 is set to be in a range of 45 degrees to 90 degrees and preferably in a range of 60 degrees to 75 degrees. Further, an angle θ2 made by the outer surface 24*a* of the inclined wall portion 24 and the outer surface 21*a* of the base portion 21 is set to be in a range of 5 degrees to 45 degrees and preferably in a range of 15 degrees to 30 degrees.

Further, as illustrated in FIG. 3, a step portion 26 is formed inside the base portion 21 so as to be recessed toward the inside of the bottle 10. The edge portion of the inclined wall portion 24 located outside the bottom 11 in the radial direction and the edge portion of the rising wall portion 25 located outside in the radial direction continue to the base portion 21 via the step portion 26. As illustrated in FIG. 2, the inner surface of the bottom 11 is formed along the outer surface of the bottom 11, and the thickness of the bottom 11 is equal throughout.

As described so far, according to the bottle 10 of the present embodiment, a plurality of ribs 27 provided with an inclined wall portion 24 and a rising wall portion 25 steeper than the inclined wall portion 24 are formed at the annular wall portion 23. Therefore, an increased internal pressure of the bottle 10 will disperse a load acting on a joint between the ridge of each rib 27, that is, an inclined wall portion 24 of each rib 27 and the rising wall portion 25 from the joint to the inclined wall portion 24. Further, even when there is exerted a force which allows the inclined wall portion 24 to move outside the bottle 10, with an edge portion opposite to the joint of the inclined wall portion 24 being used as a supporting point, the rising wall portion 25 acts against the force, thereby the inclined wall portion 24 is not deformed so as to move outside the bottle 10. Therefore, even if there is an increase in internal pressure of the bottle 10, it is possible to prevent the concentration of stress on a specific site at the outer circumference brim of the annular wall portion 23. As a result, it is possible to improve the compressive strength of the bottom 11 of the bottle 10 and also prevent the base portion 21 continuing to the outer circumference brim of the annular wall portion 23 from being deformed so as to swell to the outside.

Further, since the rib 27 is provided with the inclined wall portion 24, the annular wall portion 23 is not complicated in configuration. Therefore, the inside of the bottle can be sufficiently cleaned before a liquid or the like is filled into the bottle 10. Still further, since a cleaning liquid can easily flow along the inclined wall portion 24, the cleaning liquid can be easily discharged from the bottle 10 to prevent a decrease in the handling property of the bottle 10.

Further, in the present embodiment, each of the ribs 27, which is provided with the inclined wall portion 24 and the rising wall portion 25, continues to the base portion 21 via the step portion 26. Therefore, when the bottle 10 is produced by blow molding, a poor configuration of the bottle 10 can be prevented even when a mold is worn.

Where the above angle θ1 is smaller than 45 degrees, the rib 27 is expanded in the circumferential direction of the bottle 10 and crushed more easily. Further, where the angle θ1 is larger than 90 degrees, the bottle 10 is inferior in molding property.

Next, an explanation will be given for Embodiment 2 of the present invention. It is noted that the same parts as those of Embodiment 1 are given the same symbols and numerals and explanations thereof are omitted, with only different parts being explained here.

Figure 5:
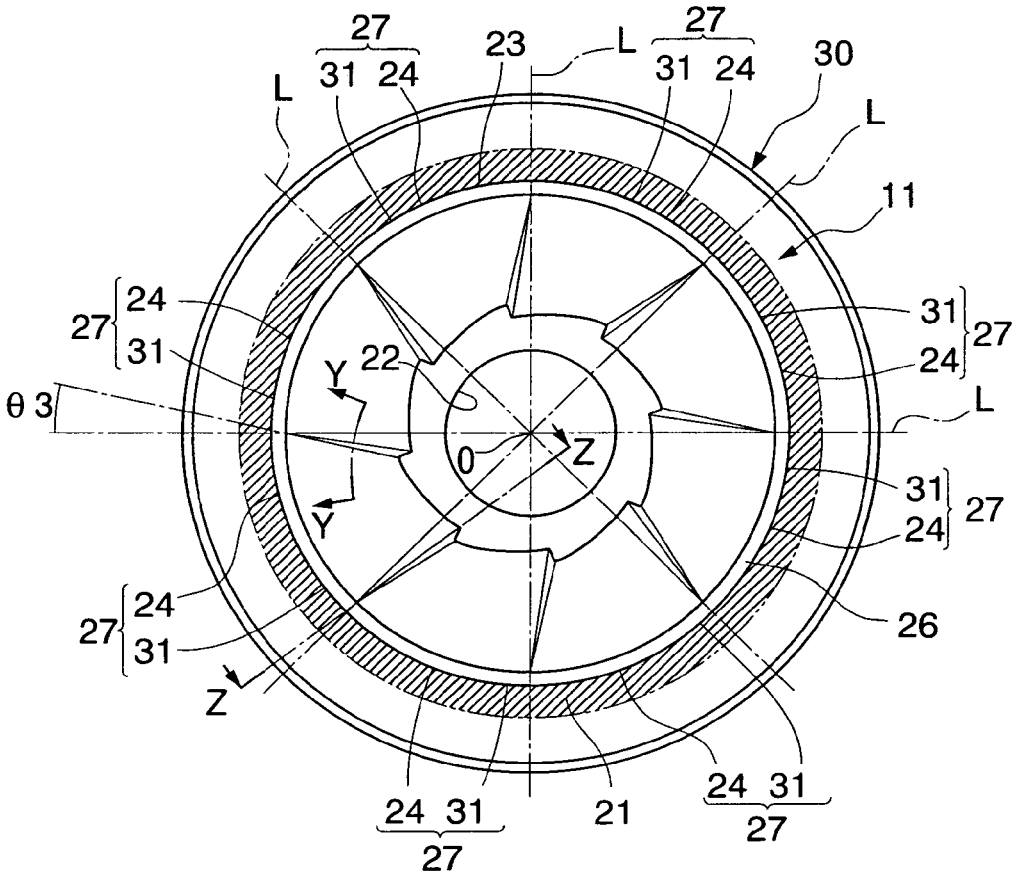
FIG. 5 is a view for illustrating Embodiment 2 of the bottle of the present invention and a plan view illustrating the bottom of the bottle.
Figure 6:
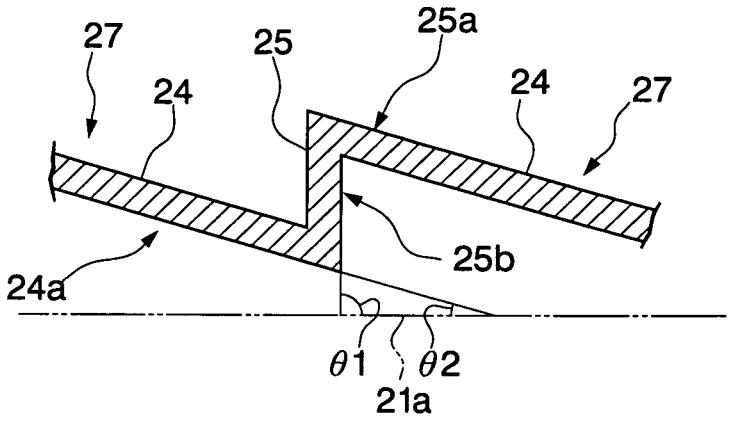
FIG. 6 is a view for illustrating an embodiment of the bottle of the present invention.

As illustrated in FIG. 5, in the present embodiment, a rising wall portion 31 constituting the rib 27 together with the inclined wall portion 24 is formed at the annular wall portion 23. When the rib 27 is viewed from below in the direction of the central axis line O, the upper brim 31*a* of the rising wall portion 31 is extended in a direction which is inclined in a radial direction to the bottom 11 of the bottle 30. In other words, the upper brim 31*a* of the rising wall portion 31 is extended in a direction inclined to a line L which connects a point at which the rising wall portion 31 is in contact with the base portion 21 with the center (central axis line O) of the bottle 30. In FIG. 5, the rising wall portion 31 of each rib 27 is extended so as to be spaced from the line L gradually in a counterclockwise direction as it moves from the base portion 21 to the central recess 22. It is noted that an angle θ3 made by a direction at which the upper brim 31*a* of the rising wall portion 31 is extended and the line L is set to be, for example, 30 degrees or less and preferably 15 degrees or less. The angle θ3 may be changed, whenever necessary, depending on the number of the ribs 27 or the like. In the present embodiment, the angle θ3 is set to be approximately 8 degrees.

As described so far, according to the present embodiment, the upper brim 31*a* of the rising wall portion 31 is extended in a direction inclined to the line L. Therefore, even when a force is exerted which allows the inclined wall portion 24 to move outside the bottle 30, with an edge portion opposite to the joint of the inclined wall portion 24 being used as a supporting point due to an increase in internal pressure of the bottle 30, the inclined wall portion 24 is deformed so as to cover the rising wall portion 31 and the rising wall portion 31 stops the force, thereby preventing the rib 27 from being expanded in a circumferential direction and deformed so as to be crushed. Therefore, it is possible to further improve the compressive strength of the bottle 30.

It is noted that the technical scope of the present invention is not limited to the above Embodiment 1 and Embodiment 2 but can be modified in various ways as long as it is not deviated from the scope of the present invention.

In the above embodiments, an explanation was made for the bottles 10, 30, the transverse cross section is substantially circular, for example. It is, however, acceptable that the bottle is such that, the transverse cross section of which is substantially rectangular.

Further, in the above embodiments, the step portion 26 is formed at the bottom 11. It is also acceptable that the step portion 26 is not formed but the edge portion of the inclined wall portion 24 located outside the bottom 11 in a radial direction and the edge portion of the rising wall portion 25 (or 31) located in the radial direction are directly connected to the base portion 21.

In the above embodiments, a joint between the inclined wall portion 24 of each rib 27 and the rising wall portion 25 is formed so as to give a ridge, while a joint between the inclined wall portion 24 with an adjacent rib 27 and the rising wall portion 25 is formed so as to form a valley. However, it is acceptable that, for example, a flat-face portion is formed between the inclined wall portion 24 and the rising wall portion 25 and the inclined wall portion 24 is connected with the rising wall portion 25 via the flat-face portion.

In the above embodiments, as illustrated in FIG. 3, the inclined wall portion 24 is inclined from the base portion 21 to the central recess 22 and also curved so as to be recessed to the inside of the bottle 10. However, the inclined wall portion 24 may be curved so as to protrude outside the bottle 10 or inclined in a flat face shape.

Further, in the above embodiments, as illustrated in FIG. 4, the inclined wall portion 24 is formed in a flat-face shape and inclined from the lower brim of the rising wall portion 25 of an adjacent rib 27 toward the upper brim 25*a* of the rising wall portion 25 to give the rib 27 in combination with itself. However, the inclined wall portion 24 may be curved so as to be recessed to the inside of the bottle 10 or may be curved so as to protrude outside the bottle 10.

In each of the above embodiments, the inclined wall portion 24 and the rising wall portion 25 (or 31) may be changed in position toward the circumferential direction of the bottle so that they can be exchanged with each other.

Next, a numerical analysis was carried out to verify the above-described actions and effects. The bottle 10 of Embodiment 1 was adopted as Example 1, and the bottle 30 of Embodiment 2 was adopted as Example 2. As a comparative example of Example 1, the bottle 10 of Embodiment 1 is adopted which is not provided with the inclined wall portion 24 or the rising wall portion 25. As a comparative example of Example 2, the bottle 30 of Embodiment 2 is adopted which is not provided with the inclined wall portion 24 or the rising wall portion 31.

Then, an internal pressure determined when the internal pressure was imparted to each of the bottles and the base portion 21 was deformed so as to swell outwardly was evaluated as a compressive strength.

As a result, each of the comparative examples was 0.147 MPa in compressive strength, whereas Example 1 was 0.333 MPa and Example 2 was 0.363 MPa. In other words, it was confirmed that Example 1 and Example 2 were improved in compressive strength two times or more than the comparative examples.

INDUSTRIAL APPLICABILITY

The present invention relates to a bottle, which is provided with a base portion installed on the outer circumference brim of the bottom, a central recess installed inside the base portion and recessed toward the inside of the bottle, an annular wall portion installed between the base portion and the central recess and inclined so as to gradually elevate from the base portion to the central recess, and a plurality of ribs installed side by side at the annular wall portion in the circumferential direction of the bottom and protruding toward the inside of the bottle, in which the ribs are provided with a rising wall portion rising toward the inside of the bottle and an inclined wall portion inclined from the upper brim of the rising wall portion toward the lower brim of the rising wall portion of an adjacent rib, and the rising wall portion is inclined more steeply than the inclined wall portion.

According to the present invention, it is possible to provide a sufficient compressive strength at the bottom of the bottle, without decreasing the handling property even when the bottle is made lighter in weight.

The invention claimed is:

1. A bottle comprising:

a base portion located on an outer circumference brim of a bottom of the bottle, the base portion touching the ground when the bottle is set upright;

a central recess located inside the base portion and recessed toward an inside of the bottle;

an annular wall portion located between the base portion and the central recess and inclined so as to elevate gradually from the base portion to the central recess; and a plurality of ribs located side by side at the annular wall portion in the circumferential direction of the bottom of the bottle and protruding toward the inside of the bottle, wherein the plurality of ribs are each provided with a rising wall portion that has an upper brim and a lower brim thereof provided between the base portion and the central recess such that the upper brim and the lower brim are rising from the base portion to the central recess, the rising wall portion rising from the lower brim to the upper brim, and an inclined wall portion that connects between the upper brim of the rising wall portion of a first rib of the plurality of ribs and the lower brim of the rising wall portion of a second adjacent rib of the plurality of ribs and is inclined from the upper brim of the rising wall portion of the first rib toward the lower brim of the rising wall portion of the second adjacent rib, when the bottom of the bottle is viewed from a cross section along the circumferential direction, an angle θ1 made by an outer surface of the rising wall portion and an outer surface of the base portion in the circumferential direction is set to be in a range of 45 to 90 degrees, and an angle θ2 made by an outer surface of the inclined wall portion and an outer surface of the base portion in the circumferential direction is set to be in a range of 5 to 45 degrees.

2. The bottle according to claim 1, wherein the angle θ1 is in a range of 60 degrees to 75 degrees, and the angle θ2 is in a range of 15 degrees to 30 degrees.

3. The bottle according to claim 1, wherein the rising wall portion is formed in a triangular shape and the inclined wall portion is formed in a fan shape.

4. The bottle according to claim 1, wherein the angle θ1 is larger than the angle θ2.

5. The bottle according to claim 1, wherein an area of the rising wall portion is larger than an area of the inclined wall portion.

6. The bottle according to claim 1, wherein the rising wall portion is formed in a triangular shape so as to be tapered as the rising wall portion comes closer to the base portion.

* * * * *